US008698072B2

(12) United States Patent
Sugawara et al.

(10) Patent No.: US 8,698,072 B2
(45) Date of Patent: Apr. 15, 2014

(54) TRIPLE QUADRUPOLE MASS SPECTROMETER

(75) Inventors: Hiroshi Sugawara, Kyoto (JP); Daisuke Okumura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/982,489

(22) PCT Filed: Sep. 30, 2011

(86) PCT No.: PCT/JP2011/072506
§ 371 (c)(1),
(2), (4) Date: Sep. 4, 2013

(87) PCT Pub. No.: WO2012/105087
PCT Pub. Date: Aug. 9, 2012

(65) Prior Publication Data

US 2013/0334415 A1 Dec. 19, 2013

(30) Foreign Application Priority Data

Jan. 31, 2011 (JP) ..... 2011-017741

(51) Int. Cl.
*H01J 49/42* (2006.01)

(52) U.S. Cl.
CPC ..... *H01J 49/42* (2013.01)
USPC ..... 250/252.1; 250/281; 250/296

(58) Field of Classification Search
USPC ..... 250/252.1, 281, 296
See application file for complete search history.

(56) References Cited

U.S. PATENT DOCUMENTS 8,269,166 B2 * 9/2012 Okumura ..... 250/288
2013/0214146 A1 * 8/2013 Okumura ..... 250/281

FOREIGN PATENT DOCUMENTS

| | | |
|---|---|---|
| JP | H02-094242 | 4/1990 |
| JP | H05-332994 | 12/1993 |
| JP | H07-201304 | 8/1995 |
| JP | H11-183439 | 7/1999 |
| WO | 2010089798 | 8/2010 |

OTHER PUBLICATIONS

"International Search Report (Form PCT/ISA/210)", published on Jan. 10, 2012, with English translation thereof, p1-p4, in which the listed references (WO2010089798, JPH05-332994, JPH02-094242) were cited.

"International Preliminary Report on Patentability; this report contains the following items :Form PCT/IB/373, PCT/ISA237(cover sheet), PCT/ISA237(Box No. 1),PCT/ISA237(Box No. V)", mailed on Aug. 6, 2013, which is English translation of "Written Opinion of the International Searching Authority", p. 1-p. 10.

* cited by examiner

*Primary Examiner* — Kiet T Nguyen
(74) *Attorney, Agent, or Firm* — Jianq Chyun IP Office

(57) ABSTRACT

A high-quality mass spectrum is provided with alleviated mass/charge axis deviation in a triple quadrupole mass spectrometer even when executing a high-speed mass scan with MS/MS analysis. Mass calibration tables which denote relations between m/z and a mass deviation value which scan speed is a parameter are prepared separately for use in MS analyses without involving dissociation operations and MS/MS analyses with involving dissociation operations. According to a measuring mode, such as a product ion scan measurement or a neutral loss scan measurement, when performing MS/MS analysis, a mass deviation value for the minimum scan speed in a table is used for a quadrupole where the selected m/z is fixed, and a mass deviation value for a designated scan speed in a table is used for a quadrupole where the mass scan is performed, thus controlling the operations of each of a pre-stage and a post-stage quadrupoles.

4 Claims, 4 Drawing Sheets

| Measuring Mode in MS Analysis | Q1 | Q3 |
|---|---|---|
| Q1-SIM | SIM | -- |
| Q1 scan | Scan | -- |
| Q3-SIM | -- | SIM |
| Q3 scan | -- | Scan |

| Measuring Mode in MS/MS Analysis | Q1 | Q3 |
|---|---|---|
| MRM | SIM | SIM |
| Precursor ion scan | Scan | SIM |
| Product ion scan | SIM | Scan |
| Neutral loss scan | Scan | Scan |

Q1 Scan Mass Calibration Table (row: scan speed; column: m/z)

22B1

| m/z | 65.05 | 168.10 | 344.20 | 652.40 | 1004.60 | 1312.80 | 0.00 |
|---|---|---|---|---|---|---|---|
| 125 | -0.94 | -0.84 | -0.69 | -0.49 | +0.05 | +0.45 | +0.00 |
| 500 | -0.85 | -0.76 | -0.60 | -0.38 | +0.18 | +0.60 | +0.00 |
| 1000 | -0.75 | -0.54 | -0.47 | -0.23 | +0.36 | +0.80 | +0.00 |
| 1500 | -0.64 | -0.52 | -0.34 | -0.07 | +0.54 | +1.01 | +0.00 |
| 2000 | -0.54 | -0.41 | -0.21 | +0.07 | +0.72 | +1.21 | +0.00 |
| 2500 | -0.43 | -0.29 | -0.08 | +0.23 | +0.90 | +1.41 | +0.00 |
| 3000 | -0.35 | -0.20 | +0.04 | +0.39 | +1.11 | +1.66 | +0.00 |

Q3 Scan Mass Calibration Table (row: scan speed; column: m/z)

22B2

| m/z | 65.05 | 168.10 | 344.20 | 652.40 | 1004.60 | 1312.80 | 0.00 |
|---|---|---|---|---|---|---|---|
| 125 | -0.94 | -0.84 | -0.64 | -0.24 | +0.25 | +0.75 | +0.00 |
| 500 | -0.91 | -0.81 | -0.61 | -0.21 | +0.29 | +0.79 | +0.00 |
| 1000 | -0.87 | -0.77 | -0.57 | -0.16 | +0.34 | +0.85 | +0.00 |
| 1500 | -0.83 | -0.73 | -0.52 | -0.11 | +0.39 | +0.90 | +0.00 |
| 2000 | -0.79 | -0.69 | -0.48 | -0.07 | +0.44 | +0.95 | +0.00 |
| 2500 | -0.76 | -0.65 | -0.44 | -0.02 | +0.49 | +1.01 | +0.00 |
| 3000 | -0.71 | -0.61 | -0.39 | +0.02 | +0.54 | +1.06 | +0.00 |

FIG. 4

(a)After Calibration; Scan Speed: 60 u/s (b)After Calibration; Scan Speed: 2000 u/s (c)Before Calibration; Scan Speed: 2000 u/s

TRIPLE QUADRUPOLE MASS SPECTROMETER

CROSS-REFERENCE TO RELATED APPLICATION

This application is a 371 application of international PCT application Ser. No. PCT/JP2011/072506, filed on Sep. 30, 2011, which claims the priority benefit of Japan application No. 2011-017741, filed on Jan. 31, 2011. The entirety of each of the above-mentioned patent applications is hereby incorporated by reference herein and made a part of this sepecification.

TECHNICAL FIELD

The invention relates to a triple quadrupole mass spectrometer capable of MS/MS analysis.

BACKGROUND ART

In a quadrupole mass spectrometer, a voltage (obtained by adding a direct-current voltage and a high-frequency voltage) according to a mass-to-charge ratio (m/z) of an ion to be measured is applied to a quadrupole mass filter, thereby allowing the ion to be measured to selectively pass through the quadrupole mass filter to be detected by a detector. Due to mechanical error of the quadrupole mass filter, variation in electronic circuit properties, operating environmental conditions and so on, in many cases, in a state that an ion having a target mass-to-charge ratio is controlled to selectively pass through the quadrupole mass filter, a shift occurs between the target mass-to-charge ratio and an actually detected mass-to-charge ratio of the ion.

In a mass calibration operation, as mentioned in Patent Document 1, firstly, a standard sample containing a component having a known theoretical value of mass-to-charge ratio is measured, and through a comparison between the theoretical value and a measured value of the mass-to-charge ratio at that time, a mass deviation at the mass-to-charge ratio is calculated and stored in advance in a memory as a calibration value. Then, when the target sample is measured, a control unit reads, from the memory, a calibration value that corresponds to the target mass-to-charge ratio, and uses it to correct the voltage applied to the quadrupole mass filter for the mass deviation to become zero. As a result, the ion having the target mass-to-charge ratio selectively passes through the quadrupole mass filter and reaches the detector for being detected.

By the way, in order to perform identification of a substance having a high molecular weight and structural analysis, a mass spectrometry means called MS/MS analysis is widely used. While a mass spectrometer for executing MS/MS analysis may have various constitutions, a triple quadrupole mass spectrometer is widely utilized because of its simpler structure and low lost.

As disclosed in Patent Document 2 and so on, a general triple quadrupole mass spectrometer is provided with a collision cell (collision chamber) between a quadrupole mass filter at a pre-stage (hereinafter "pre-stage quadrupole") and a quadrupole mass filter at a post-stage (hereinafter "post-stage quadrupole") to dissociate ions through collision induced dissociation (CID). In this collision cell, a quadrupole or multipole (more than four poles) ion guide is disposed in order to converge and transport the ions.

When various ions generated from the sample are introduced into the pre-stage quadrupole, the pre-stage quadrupole allows only ions having a specific mass-to-charge ratio to selectively pass therethrough as precursor ions. A CID gas such as argon gas is introduced into the collision cell, and the precursor ions introduced into the collision cell collide with the CID gas and dissociate, thereby generating various product ions. The precursor ions and the various product ions are converged due to an effect of a high-frequency electric field caused by the quadrupole ion guide. When the various product ions generated by CID are introduced into the post-stage quadrupole, the post-stage quadrupole allows only product ions having a specific mass-to-charge ratio to selectively pass therethrough, and the product ions capable of passing through the post-stage quadrupole reach a detector and are being detected.

With such triple quadrupole mass spectrometer, MS/MS analysis is feasible in a variety of modes such as multiple reaction monitoring (MRM) measurement, product ion scan measurement, precursor ion scan measurement, neutral loss scan measurement and so on.

In an MRM measurement, the mass-to-charge ratios of the ions capable of passing through the pre-stage quadrupole and through the post-stage quadrupole are respectively fixed, and intensity of a specific product ion with respect to a specific precursor ion is measured.

In a product ion scan measurement, while the mass-to-charge ratio of the ions passing through the pre-stage quadrupole is fixed at a certain value, the mass-to-charge ratio of the ions passing through the post-stage quadrupole is scanned in a predetermined mass-to-charge ratio range. Obtaining a mass spectrum of a product ion with respect to a specific precursor ion is thereby possible.

In a precursor ion scan measurement, in contrast to the product ion scan measurement, while the mass-to-charge ratio of the ions passing through the post-stage quadrupole is fixed at a certain value, the mass-to-charge ratio of the ions passing through the pre-stage quadrupole is scanned in a predetermined mass-to-charge ratio range. Obtaining a mass spectrum of a precursor ion that generates a specific product ion is thereby possible.

In a neutral loss scan measurement, a difference (i.e. neutral loss) between the mass-to-charge ratio of the ions passing through the pre-stage quadrupole and the mass-to-charge ratio of the ions passing through the post-stage quadrupole is maintained constant, and a mass scan is performed in the pre-stage quadrupole and the post-stage quadrupole respectively in predetermined mass-to-charge ratio ranges. Obtaining a mass spectrum of a precursor/product ion having a specific neutral loss is thereby possible.

Of course, in the triple quadrupole mass spectrometer, it is also possible to perform a normal scan measurement and a selected ion monitoring (SIM) measurement without performing CID of ions in the collision cell. In this case, neither the pre-stage quadrupole nor the post-stage quadrupole makes a selection of ions according to mass-to-charge ratio, allowing all of the ions to pass through that quadrupole.

Since the triple quadrupole mass spectrometer is provided with two quadrupole mass filters at the pre-stage and the post-stage as mentioned above, to increase selectivity of precursor ion and of product ion, it is necessary to perform mass calibrations separately and respectively at the pre-stage and at the post-stage. In a conventional triple quadrupole mass spectrometer, generally, mass calibration information for MS/MS analysis is created separately in the pre-stage quadrupole and in the post-stage quadrupole based on the measured results of MS analysis at a low scan speed using a standard sample. However, when a mass calibration is performed based on the mass calibration information obtained according to the above-mentioned method, there is a problem of an increased mass-to-charge ratio axis deviation in a mass spectrum in accordance with an increased scan speed in measuring modes such as precursor ion scan and neutral loss scan.

In addition, although an adjustment to mass resolution is performed similarly to mass calibration by utilizing measured results of MS analysis at a low scan speed using a standard sample, there are problems of reduced mass resolution in accordance with the increased scan speed in the measuring modes such as precursor ion scan and neutral loss scan (increased peak width of a peak profile with respect to one component), or of considerably reduced sensitivity for a decreased amount of ions even in the event that mass resolution is reduced.

PRIOR-ART DOCUMENTS

Patent Document

Patent Document 1: Japanese Unexamined Patent Application Publication No. Hei 11-183439

Patent Document 2: Japanese Unexamined Patent Application Publication No. Hei 7-201304

SUMMARY

In recent years, as a substance to be measured has become more and more complicated, it has been strongly desired to enhance efficiency of analysis work and also improve analysis quality. In an apparatus combining a liquid chromatograph (LC) with a triple quadrupole mass spectrometer, for example, in order to obtain structure information together with the measurement of molecular weights of multiple components contained in the sample, a product ion scan measurement is performed using an MRM measurement and a normal scan measurement as a trigger. In such a case, to sufficiently secure the number of data points per peak, or to perform a product ion scan measurement for both positive and negative ions under a plurality of collision energy conditions, repeating a scan measurement at a high scan speed and in a shorter time unit is necessary. To satisfy these requirements, mass scan must be accelerated, and the aforementioned problems of mass-to-charge ratio axis deviation and reduced mass resolution become more notable.

The invention has been achieved in order to address the above issues and mainly aims to obtain a mass spectrum with high mass precision and high mass resolution by alleviating deviation of the mass-to-charge ratio axis of the mass spectrum as well as reduction in mass resolution even in the case of performing MS/MS analysis with a high-speed scan in a triple quadrupole mass spectrometer.

A first invention achieved in order to solve the above issues is a triple quadrupole mass spectrometer including: an ion source ionizing a sample; a pre-stage quadrupole for selecting, from various ions generated by the ion source, first ions having a first specific mass-to-charge ratio as precursor ions; a collision cell performing a dissociation operation to dissociate the precursor ions; a post-stage quadrupole for selecting second ions having a second specific mass-to-charge ratio from various product ions generated by the dissociation operation; a detector detecting the second ions passing through the post-stage quadrupole, wherein the triple quadrupole mass spectrometer is characterized by including:

a) a calibration information memory unit to store in advance mass calibration information showing a relationship between mass-to-charge ratio and calibration values which takes scan speed as a parameter in each measuring mode of MS analysis not involving the dissociation operation in the collision cell and of MS/MS analysis involving the dissociation operation; and b) a control means reading unit, from the calibration information memory unit, mass calibration information corresponding to an executed measuring mode and a designated scan speed, and calibrating a mass-to-charge ratio of the second ions detected by the detector by using the mass calibration information to drive respectively the pre-stage quadrupole and the post-stage quadrupole.

In addition, a second invention achieved in order to solve the above issues is a triple quadrupole mass spectrometer including: an ion source ionizing a sample; a pre-stage quadrupole for selecting, from various ions generated by the ion source, first ions having a first specific mass-to-charge ratio as precursor ions; a collision cell performing a dissociation operation to dissociate the precursor ions; a post-stage quadrupole for selecting second ions having a second specific mass-to-charge ratio from various product ions generated by the dissociation operation; and a detector detecting the second ions passing through the post-stage quadrupole, wherein the triple quadrupole mass spectrometer is characterized by including:

a) a calibration information memory unit to store in advance, respectively, in MS analyses not involving the dissociation operation in the collision cell, mass calibration information showing a relationship between mass-to-charge ratio and calibration values of which a mass scan of the pre-stage quadrupole is performed using a scan speed as a parameter, and mass calibration information showing a relationship between mass-to-charge ratio and calibration values of which a mass scan of the post-stage quadrupole is performed using a scan speed as a parameter, and in MS/MS analyses involving the dissociation operation in the collision cell, mass calibration information showing a relationship between mass-to-charge ratio and calibration values of which a mass scan of the pre-stage quadrupole is performed using a scan speed as a parameter, and a mass calibration information showing relationship between mass-to-charge ratio and calibration values of which a mass scan of the post-stage quadrupole is performed using a scan speed of as a parameter; and b) a control unit, selecting a necessary combination among the mass calibration information stored in the calibration information memory unit according to a measuring mode of the executed MS analysis or MS/MS analysis, reading out the mass calibration information corresponding to a designated scan measurement, and calibrating a mass-to-charge ratio of the second ions detected by the detector by using the mass calibration information to drive respectively the pre-stage quadrupole and the post-stage quadrupole.

In the first invention and the second invention, a measuring mode of MS/MS analysis is typically an MRM measurement, a precursor ion scan measurement, a product ion scan measurement, and a neutral loss scan measurement. In addition, a measuring mode of MS analysis is a pre-stage quadrupole scan measurement performing a mass scan in the pre-stage quadrupole, a post-stage quadrupole scan measurement performing a mass scan in the post-stage quadrupole, a pre-stage quadrupole SIM measurement performing SIM in the pre-stage quadrupole, a post-stage quadrupole SIM measurement performing SIM in the post-stage quadrupole, and so on.

Furthermore, in the case without a mass scan, such as in an SIM or MRM measurement, among the mass calibration information showing a relationship between mass-to-charge ratio and calibration value which takes scan speed as a parameter, the mass calibration information showing a relationship between mass-to-charge ratio and calibration value that corresponds to the slowest scan speed may be utilized.

In addition, a specific example of the mass calibration information showing a relationship between mass-to-charge ratio and calibration value which takes scan speed as a parameter may be presented in a two-dimensional table, in which a plurality of cells arranged in one of the row direction and the column direction is respectively fields for setting calibration values with respect to different mass-to-charge ratios, and a plurality of cells arranged in the other one of the row direction and the column direction is respectively fields for setting calibration values with respect to different scan speeds.

Both of the triple quadrupole mass spectrometers relating to the first invention and the second invention store the mass calibration information for use in MS/MS analysis in the calibration information memory unit, which is different from the mass calibration information for MS analysis in which the dissociation of ions is not executed in the collision cell. A difference between the first invention and the second invention lies in that the first invention has the mass calibration information respectively corresponding to each measuring mode of MS analysis and MS/MS analysis as described above, while the second invention has the mass calibration information for the pre-stage quadrupole and the mass calibration information for the post-stage quadrupole that are common to each measuring mode of MS/MS analysis.

Accordingly, in the triple quadrupole mass spectrometer relating to the first invention, for example, a mass scan of the post-stage quadrupole is executed in both of a product ion scan measurement and a neutral loss scan measurement, but performing a mass calibration of the post-stage quadrupole that uses different mass calibration information in the two measuring modes is possible. Meanwhile, in the triple quadrupole mass spectrometer relating to the second invention, for example, it is not possible to perform, a mass scan of the post-stage quadrupole that uses different mass calibration information in a product ion scan measurement and a neutral loss scan measurement, but there is an advantage that only a small amount of mass calibration information needs to be stored in advance.

In any of the first invention or the second invention, the control unit obtains, from the calibration information memory unit, the mass calibration information according to a measuring mode of an executed MS analysis or MS/MS analysis and a designated scan measurement, and uses this information to drive the pre-stage quadrupole and the post-stage quadrupole respectively. For example, in a product ion scan measurement mode of MS/MS analysis, in the pre-stage quadrupole, since the mass-to-charge ratio of the passing ions is fixed, similarly to an SIM measurement and MRM measurement, among the mass calibration information of the pre-stage quadrupole corresponding to that measuring mode, the mass calibration information corresponding to the slowest scan speed is used. Meanwhile, in the post-stage quadrupole, the mass calibration information at the post-stage that corresponds to that measuring mode and to the scan speed set at that time is used.

Effects of the Invention

In this way, according to the triple quadrupole mass spectrometer relating to the first invention or the second invention, during a MS/MS analysis of performing a mass scan at one or both of the pre-stage quadrupole and the post-stage quadrupole, even if the scan speed is increased, since an appropriate mass calibration is performed according to the scan speed, it is possible to suppress a deviation of the mass-to-charge ratio axis of a mass spectrum (MS/MS spectrum). Accordingly, a mass spectrum with high mass precision may be obtained, and quantitative precision as well as precision of structural analysis for a target component may also be improved.

In addition, in the triple quadrupole mass spectrometer relating to the first invention or the second invention, in addition to the calibration values of the mass-to-charge ratios, the aforementioned calibration values also include calibration values for adjusting mass resolution. The aforementioned control unit may be configured to adjust the mass resolution at the same time of calibrating the mass-to-charge ratio of the ions detected by the aforementioned detector.

According to this configuration, during a MS/MS analysis in which a mass scan at one or both of the pre-stage quadrupole and the post-stage quadrupole is performed, even if the scan speed is increased, not only an appropriate mass calibration according to the scan speed, but also an adjustment to the mass resolution is performed. Hence, a reduction in mass resolution of the mass spectrum (MS/MS spectrum) and in sensitivity may be suppressed. As a result, a mass spectrum of high quality may be obtained, and quantitative precision as well as precision of structural analysis for a target component may also be improved.

In addition, in the event that the mass-to-charge ratio axis deviation becomes large or the mass resolution is reduced when the scan speed is increased as occurs conventionally, it is necessary for a user to make adjustments to the mass-to-charge ratio axis deviation and mass resolution according to the difference in scan speed. By contrast, with the triple quadrupole mass spectrometer relating to the first invention or the second invention, because the mass-to-charge ratio axis deviation and the reduction in mass resolution are suppressed over a wide range of scan speeds from low to high, it is unnecessary to make a re-adjustment according to the difference in scan speed as mentioned above. For that reason, for example, a variety of analyses ranging from low-speed analysis such as MRM measurement to high-speed analysis such as product ion scan measurement or a measurement involving the other scan measurements may be combined properly and executed while switched simultaneously, i.e. in a short time, so that the user performs analyses efficiently and with less burden.

BRIEF DESCRIPTION OF THE DRAWINGS

FIG. 4 shows a specific example of a mass calibration table for MS/MS analysis.

DESCRIPTION OF THE EMBODIMENTS

Figures 1, 2:
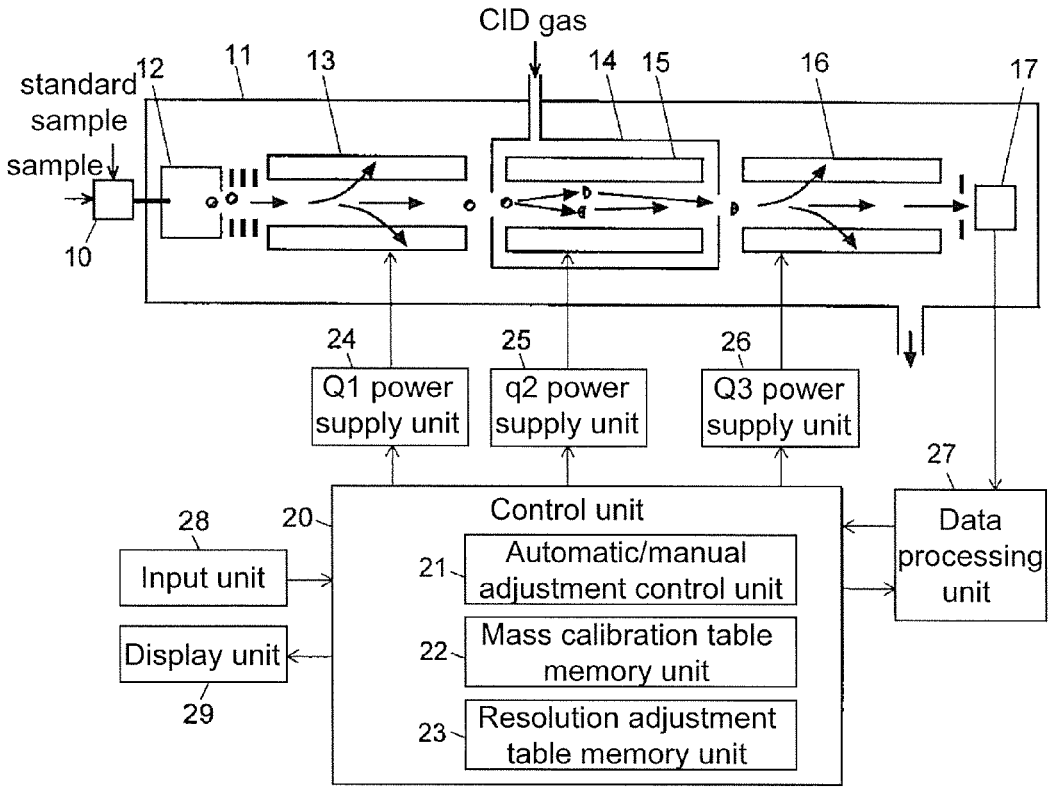
FIG. 1 is a schematic configuration diagram of a triple quadrupole mass spectrometer according to one embodiment of the invention.
FIG. 2 shows driving modes of a pre-stage quadrupole (Q1) and a post-stage quadrupole (Q3) in MS analysis and MS/MS analysis.

In the following, a triple quadrupole mass spectrometer according to one embodiment of the invention is described with reference to accompanying drawings. FIG. 1 is a schematic configuration diagram of the triple quadrupole mass spectrometer according to the present embodiment.

In an analysis chamber 11 vacuumed by an unillustrated vacuum pump, the triple quadrupole mass spectrometer of the present embodiment comprises an ion source 12 ionizing a sample as an object to be measured, a pre-stage quadrupole mass filter 13 (pre-stage quadrupole) and a post-stage quadrupole mass filter 16 (post-stage quadrupole) and each of which comprises four rod electrodes, a collision cell 14 having a multipole ion guide 15 disposed therein, and a detector 17 detecting ions and outputting detection signals according to the amount of the ions. A passage switching unit 10 switches between a sample as an object to be measured which is supplied from, for example, unillustrated liquid chromatograph and gas chromatograph and a standard sample for calibration and adjustment, and supplies them to the ion source 12. The standard sample may be various compounds such as PEG (polyethylene glycol), TFA (trifluoroacetic acid), PFTBA (perfluorotributylamine) and so on. When the sample is liquid, the ion source 12 may be an atmospheric ion source such as ESI, APCI, APPI and so on; when the sample is gas, the ion source 12 may be EI, CI and so on. In addition FIG. 1 depicts a case that an exemplary LCMSMS (or LCMS) is adopted, where LC represents liquid chromatography. Also, for a GCMSMS (or LCMS), the ion source and the vacuumed chamber may be independent. In such case, ions are ionized at atmospheric environment, and the transported to the vacuumed chamber.

A control unit 20 connected with an input unit 28 and a display unit 29 includes an automatic/manual adjustment control unit 21, a mass calibration table memory unit 22, a resolution adjustment table memory unit 23 and so on. Under the control of the control unit 20, predetermined voltages from a Q1 power supply unit 24, a q2 power supply unit 25, and a Q3 power supply unit 26 are applied respectively to the pre-stage quadrupole 13, the multipole ion guide 15, and the post-stage quadrupole 16. In addition, the detection signals (ion intensity signals) from the detector 17 are inputted to a data processing unit 27, and the data processing unit 27 executes a predetermined data processing to produce a mass spectrum and so on. Furthermore, the control unit 20 and the data processing unit 27 are functional blocks which are embodied by using a personal computer as hardware and executing dedicated control/processing software installed in the computer.

As is well known, under the control of the control unit 20, any of the voltage applied from the Q1 power supply unit 24 to the pre-stage quadrupole 13 and the voltage applied from the Q3 power supply unit 26 to the post-stage quadrupole 16 is a voltage obtained by adding a high-frequency voltage to a direct-current voltage. In addition, the voltage applied from the q2 power supply unit 25 to the multipole ion guide 15 is a high-frequency voltage for converging ions. However, generally, direct-current bias voltages are further applied to the quadrupoles 13, 16 and the ion guide 14 as well.

In the triple quadrupole mass spectrometer of the present embodiment, for a normal MS analysis without performing an ion dissociation operation in the collision cell 14, four measuring modes are prepared: pre-stage quadrupole SIM measurement, pre-stage quadrupole scan measurement, post-stage quadrupole SIM measurement, and post-stage quadrupole scan measurement. In addition, for an MS/MS analysis that performs an ion dissociation operation in the collision cell 14, four measuring modes are prepared: MRM measurement, precursor ion scan measurement, product ion scan measurement, and neutral loss scan measurement. The driving modes of the pre-stage quadrupole 13 (denoted as "Q1") and the post-stage quadrupole 16 (denoted as "Q3") in each of these measuring modes are shown by FIG. 2.

"SIM" in FIG. 2 has the same meaning as in "SIM measurement," which is to drive a quadrupole to allow only ions having a designated specific mass-to-charge ratio to pass therethrough. In addition, "scan" has the same meaning as in "scan measurement," which is to drive a quadrupole to perform a mass scan in a designated mass-to-charge ratio range with a designated scan measurement. As apparent from FIG. 2, in MS analysis, either the pre-stage quadrupole 13 or the post-stage quadrupole 16 is set in either an SIM driving mode or a scan driving mode. In MS/MS analysis, the pre-stage quadrupole 13 and the post-stage quadrupole 16 are respectively set in any of the SIM driving mode and the scan driving mode.

Figure 3:
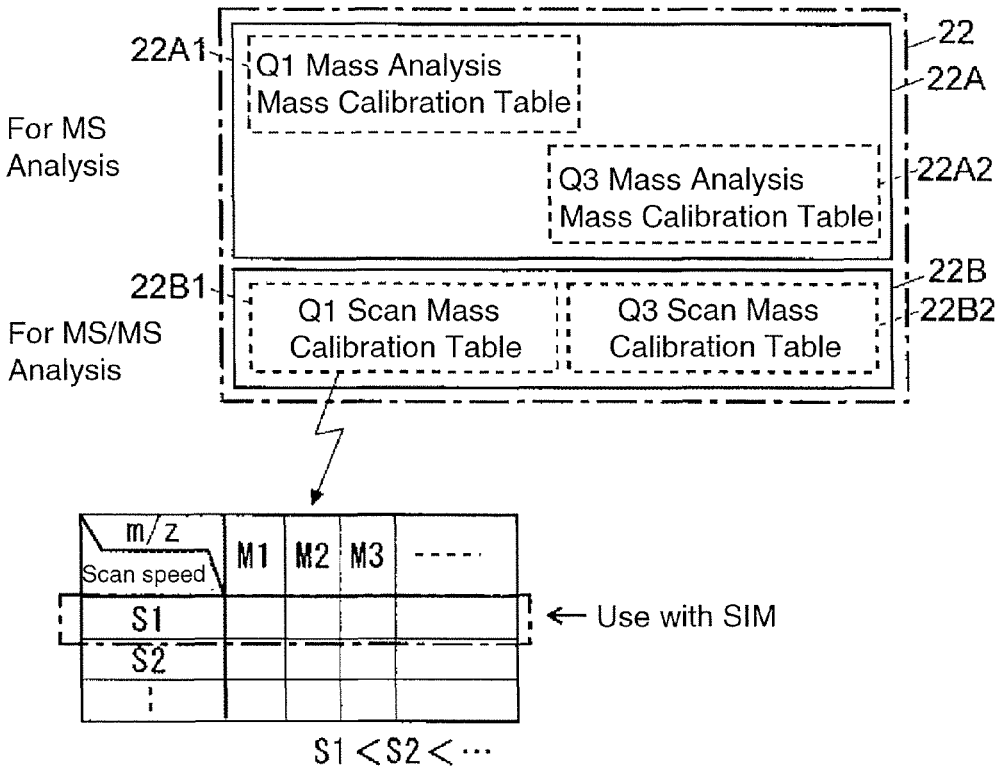
FIG. 3 is a schematic diagram showing the content of a mass calibration table of the triple quadrupole mass spectrometer of the present embodiment.

FIG. 3 is a schematic diagram showing the content of tables stored in the mass calibration table memory unit 22. As illustrated, the tables stored in the mass calibration table memory unit 22 include mass calibration table group 22A for the MS analysis and mass calibration table group 22B for the MS/MS analysis, wherein the mass calibration table group 22A for the MS analysis include a Q1 mass analysis mass calibration table 22A1 and a Q3 mass analysis mass calibration table 22A2, and the mass calibration table group 22B for the MS/MS analysis include a Q1 scan mass calibration table 22B1 and a Q3 scan mass calibration table 22B2. That is, there are four mass calibration tables stored in the mass calibration table memory unit 22.

Mass deviation values, from one mass calibration table which is a two-dimensional table, is entered in each cell which respectively takes different scan speeds (S1, S2, . . . ) in the row direction and different mass-to-charge ratios (M1, M2, M3, . . . ) in the column direction as parameters. One may perceive that this table shows a relationship between mass-to-charge ratio and mass deviation at each scan speed.

FIG. 4 is an actual example of two mass calibration tables included in the mass calibration tables 22B for MS/MS analysis. For example, cells in the first row of the Q1 scan mass calibration table 22B1, from left to right, respectively show the mass deviation values corresponding to m/z 65.05, m/z 168.10, m/z 344.20, m/z 652.40, m/z 1004.60 and m/z 1312.80 at the minimum scan speed of 125 u/s.

The triple quadrupole mass spectrometer of the present embodiment creates in advance a mass calibration table as described above based on an analysis result of the standard sample at an appropriate time point before measuring a target sample. Methods of creating the mass calibration table, namely, methods of obtaining the mass deviation values corresponding to each mass-to-charge ratio include an automatic adjustment method and a manual adjustment method. In the case of the automatic adjustment method, a mass calibration table is created using the following steps.

When instructed to make an automatic adjustment, the automatic/manual adjustment control unit 21 controls the passage switching unit 10 so that the standard sample is introduced continuously into the ion source 12. In addition, the Q3 power supply unit 26 is also controlled so that ions pass through the post-stage quadrupole 16 without stopping (i.e. without execution of the selection based on mass-to-charge ratio). In this case, the voltage for ion selection is not applied, or a voltage enabling the post-stage quadrupole 16 to function simply as an ion guide is applied, from the Q3 power supply unit 26 to the post-stage quadrupole 16. In addition, a bias voltage applied is adjusted in a manner that the CID gas is not supplied to the collision cell 14, or the collision energy is reduced if the CID gas is supplied, and then the ion dissociation in the collision cell 14 is suppressed, so as to be in a state that peak sensitivity of the mass-to-charge ratio for adjustment is sufficiently obtained. In this state, the automatic/manual adjustment control unit 21 controls the Q1 power supply unit 24 to perform a mass scan in the pre-stage quadrupole 13 at a plurality of stages of scan speeds S1, S2, . . . in a predetermined mass-to-charge ratio range. At this moment, the voltage applied to the pre-stage quadrupole 13 is determined by a default value set at, for example, a stage when this apparatus is delivered to a user.

The data processing unit 27 obtains a peak profile in a predetermined mass-to-charge ratio range at each scan speed based on the detection signals obtained from the detector 17 in each mass scan. Furthermore, normally, the peak profile is created by adding up data obtained by a plurality of scan measurements executed at the same scan speed. This peak profile represents a relationship between mass-to-charge ratio and signal intensity for successive ions during a mass scan, and a peak waveform corresponding to a standard component contained in the standard sample is observed on the peak profile.

A precise mass-to-charge ratio (e.g. theoretical value) of the standard component is known. If there is no mass deviation, a measured value of the mass-to-charge ratio obtained at a peak position (e.g. position of center of gravity of the peak waveform) of the standard component observed on the peak profile is expected to be consistent with the theoretical value of the mass-to-charge ratio. However, in reality, due to various reasons, mass deviation that varies with specific characteristic of devices or with passage of time and surrounding environments even in the same device exists. Here, the automatic/manual adjustment control unit 21 obtains a difference between the measured value and the theoretical value, i.e. a mass deviation value, for each mass-to-charge ratio at which a peak of the standard component appears. This is the mass deviation value mentioned in the Q1 mass analysis mass calibration table 22A1.

Next, the automatic/manual adjustment control unit 21 controls the Q1 power supply unit 24 so that ions pass through the pre-stage quadrupole 13 without stopping (i.e. without execution of the selection based on mass-to-charge ratio). In this case, a voltage for ion selection is not applied, or a voltage enabling the pre-stage quadrupole 13 to function simply as an ion guide is applied, from the Q1 power supply unit 24 to the pre-stage quadrupole 13. In this state, the automatic/manual adjustment control unit 21 controls the Q3 power supply unit 26 in a manner that a mass scan in a predetermined mass-to-charge ratio range is performed at a plurality of stages of scan speeds S1, S2, . . . in the post-stage quadrupole 16. At this moment, the voltage applied to the post-stage quadrupole 16 is also determined by a default value set at, for example, a stage when this apparatus is delivered to a user.

Similarly to the mass scan in the pre-stage quadrupole 13, the data processing unit 27 obtains a peak profile in a predetermined mass-to-charge ratio range at each scan speed based on the detection signals obtained from the detector 17 in each mass scan. Then, the automatic/manual adjustment control unit 21 obtains a difference between the measured value and the theoretical value of mass-to-charge ratio, i.e. a mass deviation value, for each mass-to-charge ratio at which a peak of the standard component appears. This is the mass deviation value mentioned in the Q3 mass analysis mass calibration table 22A2.

If the Q1 mass analysis mass calibration table 22A1 and the Q3 mass analysis mass calibration table 22A2 are obtained as described above, the automatic/manual adjustment control unit 21 copies the data of the Q1 mass analysis mass calibration table 22A1 to the Q1 scan mass calibration table 22B1, and copies the data of the Q3 mass analysis mass calibration table 22A2 to the Q3 scan mass calibration table 22B2. Accordingly, all of the mass calibration tables 22A1, 22A2, 22B1 and 22B2 shown in FIG. 3 are completed.

In the event that the shape of a measured peak profile is not so good for reasons such as relatively low purity of the standard sample and so on, a sufficiently precise calibration may not be obtained by the aforementioned automatic adjustment. In addition, depending on purpose of the analysis and so on, there may be cases that the user desires to perform an analysis of a specific component with high precision in a specific measuring mode, and a precision higher than that for the mass calibration by the automatic adjustment is required. In such cases, a manual mass calibration is executed by the users themselves or a service representative. When instructed to execute a manual adjustment, the automatic/manual adjustment control unit 21 displays a mass calibration table as shown in FIG. 4 as well as a peak profile at any scan speed and mass-to-charge ratio given in the table on a screen of the display unit 29.

An operator selects any of the cells in the displayed mass calibration table to display a peak profile near the mass-to-charge ratio corresponding to the cell, and appropriately rewrites a mass deviation value in the designated cell so that a target centroid peak approaches the center of the horizontal axis (mass-to-charge ratio axis) of a peak profile waveform display frame. Accordingly, the calibration value with respect to the mass-to-charge ratio is determined. Based on his own experience, in the same way, the operator may determine the calibration values corresponding to all of the cells in the mass calibration table by adjusting one by one the calibration values at peaks corresponding to different mass-to-charge ratios and scan speeds. In such manual adjustment, since the operator is able to visually judge the deformation of the peak waveform, it is possible to accurately obtain the mass deviation at each peak. Furthermore, to perform the manual adjustment more efficiently, a method such as that proposed in Japanese Patent Application No. 2010-185790 by the present applicant, for example, may be employed.

Next, in a state that the mass calibration table is stored in the mass calibration table memory unit 22 as described above, operations during the execution of an analysis of the target sample are explained. Here, a case of executing a product ion scan measurement to the target sample is described as one example.

In the case of the product ion scan measurement, parameters of the analysis condition such as mass-to-charge ratio range and scan speed in the post-stage quadrupole 16, mass-to-charge ratio of a precursor ion and so on are set by the input unit 28. However, as mentioned previously, in the event that the product ion scan measurement is performed using an MRM measurement and a normal scan measurement as a trigger, the mass-to-charge ratio of the precursor ion and so on are automatically determined by results of the MRM measurement and the scan measurement. An example is given here in which the analysis condition parameters are set as follows: scan speed=2000 u/s, and mass-to-charge ratio of the precursor ion (m/z)=1200.

The control unit 20 reads the calibration values corresponding to the minimum scan speed of 125 u/s in the Q1 scan mass calibration table 22B1 stored in the mass calibration table memory unit 22, namely, the calibration values (−0.94, −0.84, . . . ) in the first row of the Q1 scan mass calibration table 22B1 in FIG. 4. Then, the calibration values with respect to the mass-to-charge ratio m/z 1200 of the target precursor ion are calculated from the calibration values corresponding to each of the mass-to-charge ratios using, for example, an interpolation procedure. Here, the reason to employ the calibration values corresponding to the minimum scan speed of 125 u/s is that, as shown in FIG. 2, the pre-stage quadrupole 13 is driven in an SIM driving mode in the product ion scan measurement. The control unit 20 uses the above calibration values obtained by calculation to control the Q1 power supply unit 24 and allows the ions having a mass-to-charge ratio m/z 1200 to selectively pass through the pre-stage quadrupole 13.

Also, from the Q3 scan mass calibration table 22B2 stored in the mass calibration table memory unit 22, the control unit 20 reads the calibration values corresponding to the designated scan speed of 2000 u/s, namely, the calibration values −0.79, −0.69, −0.48, . . . in the fifth row of the Q3 scan mass calibration table 22B2 in FIG. 4. Then, the control unit 20 uses the read-out calibration values to control the Q3 power supply unit 26, and a mass scan is repeated in the post-stage quadrupole 16 at the scan speed of 2000 u/s in a predetermined mass-to-charge ratio range.

In a state that the pre-stage quadrupole 13 and the post-stage quadrupole 16 are respectively set as described above, when the target sample is introduced into the ion source 12, components in the sample are ionized by the ion source 12. Among the various ions that are generated, only ions having the mass-to-charge ratio m/z 1200 selectively pass through the pre-stage quadrupole 13, and are introduced into the collision cell 14 as precursor ions. The CID gas is continuously introduced into the collision cell 14, and the precursor ions contact with the CID gas and dissociate, thus generating various product ions. The product ions are converged and transported by a high-frequency electric field caused by the multipole ion guide 15, and are sent into the post-stage quadrupole 16. Since the mass scan as described above is performed in the post-stage quadrupole 16, among the various product ions, only product ions having a mass-to-charge ratio satisfying the passing requirements pass through the post-stage quadrupole 16, reach the detector 17 and are detected. The data processing unit 27 receives the detection signals from the detector 17, creates a peak profile in a predetermined mass-to-charge ratio range, and further creates a mass spectrum (MS/MS spectrum with respect to the precursor ions having an m/z of 1200) by obtaining a centroid peak of each peak waveform.

Furthermore, although in the above example, one of the scan speeds registered in the mass calibration table is set as an analysis condition parameter, when a scan speed (e.g. 1750 u/s, etc. in the example of FIG. 4) not registered in the mass calibration table is set as the analysis condition parameter, a calibration value corresponding to a desired scan speed may be obtained from the calibration values in the mass calibration table using an interpolation procedure.

In the case of performing an MRM measurement not involving a mass scan, since the pre-stage quadrupole 13 and the post-stage quadrupole 16 are both in the SIM driving mode, a calibration value corresponding to the minimum scan speed of 125 u/s in the Q1 scan mass calibration table 22B1 stored in the mass calibration table memory unit 22 is used for driving of the pre-stage quadrupole 13, and a calibration value corresponding to the minimum scan speed of 125 u/s in the Q3 scan mass calibration table 22B2 stored in the mass calibration table memory unit 22 is used for driving of the post-stage quadrupole 16. Here, the reason to use the calibration value corresponding to the minimum scan speed of 125 u/s is that the calibration value is confirm advance to be the same at slower scan speeds as at the scan speed of 125 u/s. Accordingly, if the calibration value is confirmed to be the same at faster speeds as at 125 u/s, instead of the calibration value corresponding to the minimum scan speed in the mass calibration table, a calibration value corresponding to a faster scan speed may be selected.

When performing a neutral loss scan measurement, since the pre-stage quadrupole 13 and the post-stage quadrupole 16 are both in a scan driving mode, a calibration value corresponding to a scan speed which is designated as a scan speed of the pre-stage quadrupole 13 in the Q1 scan mass calibration table 22B1 stored in the mass calibration table memory unit 22 is used for driving of the pre-stage quadrupole 13, and a calibration value corresponding to a scan speed which is designated as a scan speed of the post-stage quadrupole 16 in the Q3 scan mass calibration table 22B2 is used for driving of the post-stage quadrupole 16.

In addition, in the case of not performing MS/MS analysis but performing MS analysis that does not involve dissociation operations, according to the measuring modes as described in FIG. 2, the Q1 mass analysis mass calibration table 22A1 or the Q3 mass analysis mass calibration table 22A2 stored in the mass calibration table memory unit 22 is selected, and calibration values corresponding to a designated scan speed or calibration values corresponding to the minimum scan speed of 125 u/s are read and are used for driving the pre-stage quadrupole 13 or the post-stage quadrupole 16.

Although the above descriptions only concern mass calibration, with regard to mass resolution, similarly, tables showing a relationship between mass-to-charge ratio and resolution adjustment value that takes scan speed as a parameter are stored independently for MS analysis and for MS/MS analysis, and also independently for the pre-stage quadrupole 13 and for post-stage quadrupole 16 in the resolution adjustment table memory unit 23, and a control using the resolution adjustment values specified in this table is executed. Accordingly, good mass spectra may be obtained for both mass precision and mass resolution.

Figure 5:
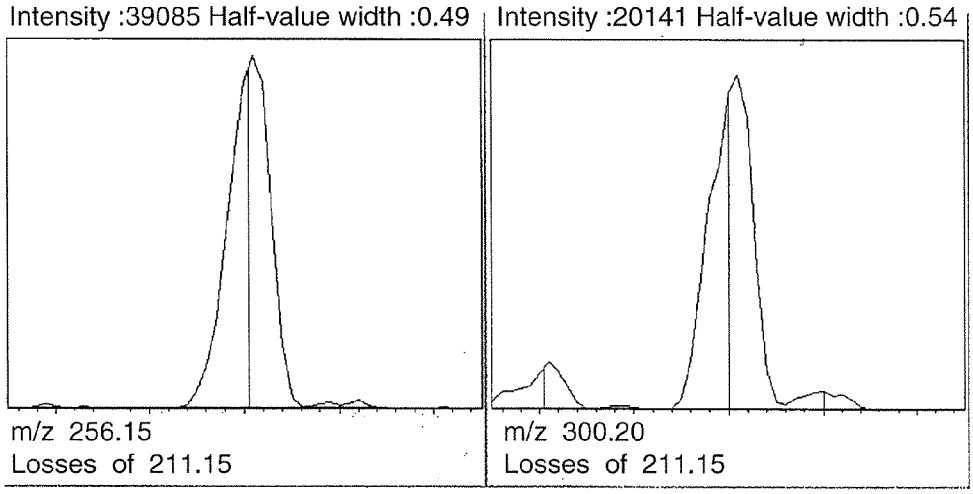
FIG. 5 shows an actual measurement example according to the triple quadrupole mass spectrometer of the present embodiment.
Figure 5:
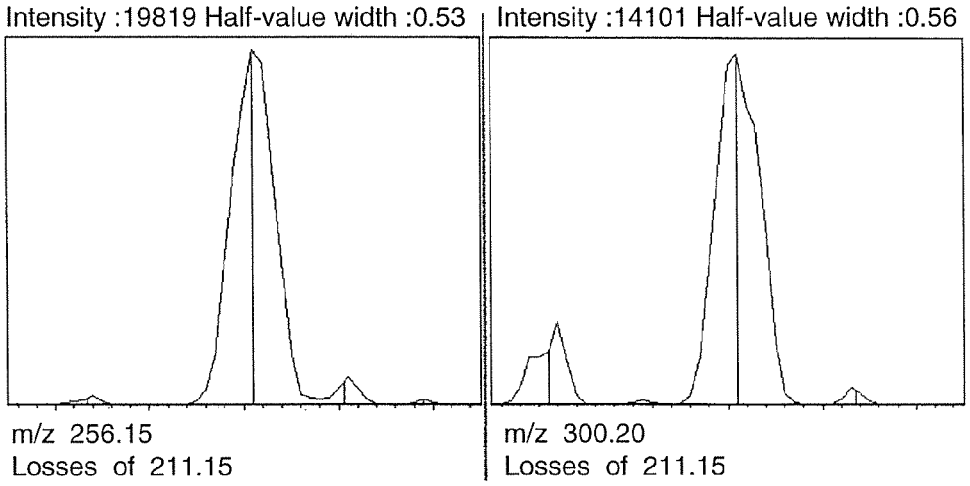
Figure 5:
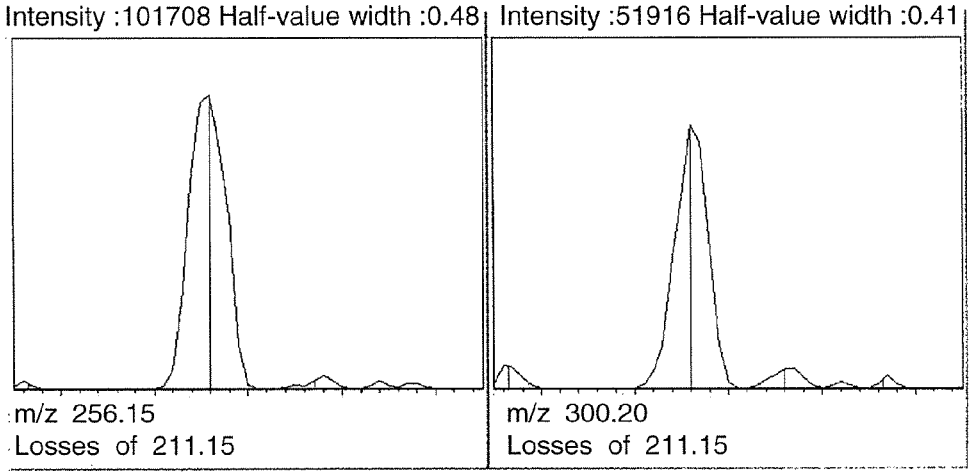

FIGS. 5A-5C show specific peak profile waveforms of a neutral loss scan measurement of an actual example, wherein FIG. 5A is a case where the scan speed is 60 u/s (low speed) and FIG. 5B is a case where the scan speed is 2000 u/s (high speed). In addition, FIG. 5C shows the results of a case at the scan speed of 2000 u/s (high speed) without performing the aforementioned mass calibration for comparison purposes. As shown in FIG. 5C, in a state that no mass calibration is performed, the centroid peak shown by a vertical line drastically deviates from the center of the graph's horizontal axis, indicating a large deviation of mass-to-charge ratio. By contrast, in the case of performing the aforementioned mass calibration, as shown in FIG. 5B, even at a high scan speed, the centroid peak is located at substantially center of the graph's horizontal axis, indicating a smaller deviation of mass-to-charge ratio. In addition, from the fact that even at a high scan speed, the peak width is approximately the same as that at a low scan speed and sufficient intensity is secured, it is clear that the mass resolution is also adjusted approximately.

As mentioned above, the triple quadrupole mass spectrometer of the present embodiment is capable of suppressing mass-to-charge ratio axis deviation and reduction in mass resolution even at a high scan speed. In addition, accordingly, throughout a wide range of scan speeds from low to high, mass precision and mass resolution are maintained high without the user's re-adjustment work. For that reason, for example, from low-speed analyses to high-speed analyses, various analyses may be properly combined to execute concurrently.

In addition, in the aforementioned embodiment, only two tables including a table for mass calibration (Q1 scan mass calibration table 22B1) in the pre-stage quadrupole 13 and a table for mass calibration (Q3 scan mass calibration table 22B2) in the post-stage quadrupole 16 are provided for MS/MS analysis, and these two tables are used in all measuring modes. For that reason, although the memory capacity of the mass calibration table memory unit 22 may be saved, it is not possible to utilize different calibration values in each measuring mode in MS/MS analysis. Therefore, in a variant example, a mass calibration table may be prepared for each measuring mode. In that case, in an automatic adjustment, the same calibration value may be set with respect to different measuring modes, and the calibration value may be changed for each measuring mode by manual adjustment.

In addition, the aforementioned embodiment is only one example of the invention, and any change, addition or modification appropriately made within the spirit of the present invention will be obviously included in the scope of claims of the present patent application.

What is claimed is:

1. A triple quadrupole mass spectrometer, comprising:

an ion source, ionizing a sample;

a pre-stage quadrupole, for selecting, from various ions generated by the ion source, first ions having a first specific mass-to-charge ratio as precursor ions;

a collision cell, performing a dissociation operation to dissociate the precursor ions;

a post-stage quadrupole, for selecting second ions having a second specific mass-to-charge ratio from various product ions generated by the dissociation operation;

a detector, detecting the second ions passing through the post-stage quadrupole;

a calibration information memory unit to store in advance mass calibration information showing a relationship between a mass-to-charge ratio and calibration values in each measuring mode, in which a scan speed is used as a parameter, of a MS analysis not involving the dissociation operation in the collision cell and of a MS/MS analysis involving the dissociation operation; and a control unit, reading, from the calibration information memory unit, mass calibration information corresponding to an executed measuring mode and a designated scan speed, and calibrating a mass-to-charge ratio of the second ions detected by the detector by using the mass calibration information to drive respectively the pre-stage quadrupole and the post-stage quadrupole.

2. The triple quadrupole mass spectrometer according to claim 1, wherein the calibration values comprise, in addition to a calibration value of the mass-to-charge ratio, a calibration value for adjusting a mass resolution, and the control unit executes an adjustment to the mass resolution at the same time of calibrating the mass-to-charge ratio of the second ions detected by the detector.

3. A triple quadrupole mass spectrometer, comprising:

an ion source, ionizing a sample;

a pre-stage quadrupole, for selecting, from various ions generated by the ion source, first ions having a first specific mass-to-charge ratio as precursor ions;

a collision cell, performing a dissociation operation to dissociate the precursor ions;

a post-stage quadrupole, for selecting second ions having a second specific mass-to-charge ratio from various product ions generated by the dissociation operation;

a detector, detecting the second ions passing through the post-stage quadrupole;

a calibration information memory unit, means to store in advance, respectively, in MS analyses not involving the dissociation operation in the collision cell, a mass calibration information showing a relationship between a mass-to-charge ratio and calibration values of which a mass scan of the pre-stage quadrupole is performed using a scan speed as a parameter, and a mass calibration information showing a relationship between mass-to-charge ratio and calibration values of which a mass scan of the post-stage quadrupole is performed using a scan speed as a parameter, and in MS/MS analyses involving the dissociation operation in the collision cell, a mass calibration information showing a relationship between a mass-to-charge ratio and calibration values of which a mass scan of the pre-stage quadrupole is performed using a scan speed as a parameter, and a mass calibration information showing a relationship between a mass-to-charge ratio and calibration values of which a mass scan of the post-stage quadrupole is performed using a scan speed as a parameter; and a control unit, selecting a necessary combination among the mass calibration information stored in the calibration information memory unit according to a measuring mode of the executed MS analysis or MS/MS analysis, reading out the mass calibration information corresponding to a designated scan measurement, and calibrating a mass-to-charge ratio of the second ions detected by the detector by using the mass calibration information to drive respectively the pre-stage quadrupole and the post-stage quadrupole.

4. The triple quadrupole mass spectrometer according to claim 3, wherein the calibration values comprise, in addition to a calibration value of the mass-to- charge ratio, a calibration value for adjusting a mass resolution, and the control unit executes an adjustment to the mass resolution at the same time of calibrating the mass-to-charge ratio of the second ions detected by the detector.

* * * * *